US007143486B2

(12) United States Patent
Rolla

(10) Patent No.: US 7,143,486 B2
(45) Date of Patent: Dec. 5, 2006

(54) ANCHORING DEVICE FOR FASTENING LACES

(76) Inventor: José Santiago Rolla, Perón 1219 - piso 3° "14", Buenos Aires (AR) 1038

( * ) Notice: Subject to any disclaimer, the term of this patent is extended or adjusted under 35 U.S.C. 154(b) by 43 days.

(21) Appl. No.: 10/847,181

(22) Filed: May 17, 2004

(65) Prior Publication Data

US 2005/0172463 A1 Aug. 11, 2005

(30) Foreign Application Priority Data

Feb. 6, 2004 (AR) ..... P040100375

(51) Int. Cl.
*A43C 7/00* (2006.01)

(52) U.S. Cl. ..... 24/712.9

(58) Field of Classification Search ..... 24/712.1, 24/115 R, 712.4–712.7, 712.2, 127, 712.9, 24/130, 129 R, 129 A, 50, 50.1; 36/50, 50.1
See application file for complete search history.

(56) References Cited

U.S. PATENT DOCUMENTS

| | | | | | |
|---|---|---|---|---|---|
| 475,245 | A | * | 5/1892 | Mooney | 24/712.9 |
| 756,940 | A | * | 4/1904 | Conger | 24/712.7 |
| 835,656 | A | * | 11/1906 | Armann | 24/712.7 |
| 1,072,594 | A | * | 9/1913 | Ferrara | 24/712.9 |
| 2,164,123 | A | | 6/1939 | Rio | |
| 2,254,579 | A | | 9/1941 | Okie | |
| 3,057,029 | A | | 10/1962 | Miller, Jr. et al. | |
| 3,057,109 | A | * | 10/1962 | Houk | 24/136 R |
| 3,176,362 | A | | 4/1965 | Tarnes | |
| 3,290,745 | A | | 12/1966 | Maxwell et al. | |
| 3,296,669 | A | * | 1/1967 | Elder, Jr. | 24/712.6 |
| 3,473,198 | A | | 10/1969 | Meier | |
| 3,864,790 | A | | 2/1975 | Reinwall, Jr. | |
| 4,485,529 | A | | 12/1984 | Blum | |
| 4,553,293 | A | | 11/1985 | Blum | |
| 5,315,741 | A | | 5/1994 | Dubberke | |
| 5,333,398 | A | * | 8/1994 | Seo | 24/712.9 |
| D375,831 | S | * | 11/1996 | Perry | D2/978 |
| 5,903,959 | A | | 5/1999 | Leonardi | |
| 5,924,177 | A | * | 7/1999 | Jongejan | 24/712.2 |
| 6,148,489 | A | | 11/2000 | Dickie et al. | |
| 6,247,214 | B1 | | 6/2001 | Hyde | |
| 6,473,944 | B1 | | 11/2002 | Vazin | |
| 6,502,286 | B1 | | 1/2003 | Dubberke | |
| 2003/0000053 | A1 | | 1/2003 | Rooney et al. | |
| 2003/0070268 | A1 | | 4/2003 | Ross | |
| 2003/0126726 | A1 | | 7/2003 | Hsu | |

FOREIGN PATENT DOCUMENTS

| | | |
|---|---|---|
| AU | 753668 B2 | 2/2001 |
| DE | 89 13 481.8 | 7/1990 |
| DE | 92 06 822.7 | 10/1992 |
| DE | 298 08 021 U1 | 10/1998 |

(Continued)

*Primary Examiner*—Robert J. Sandy
*Assistant Examiner*—Ruth C. Rodriguez
(74) *Attorney, Agent, or Firm*—Emrich & Dithmar LLC

(57) ABSTRACT

The present invention is an anchoring device for fastening laces which includes a structure having a supporting base and a pair of overlapping throat members which hold sections of the fastening lace. The bottom throat member forms a reel and includes retention ledges which retain a winding section of the lace that is wrapped about the reel. The upper throat member forms a reel having retention ledges which retain a winding section of the lace that may be wrapped about the reel.

19 Claims, 3 Drawing Sheets

FOREIGN PATENT DOCUMENTS

| | | |
|---|---|---|
| DE | 201 16 755 U1 | 2/2002 |
| EP | 0 314 628 A2 | 5/1989 |
| EP | 1 103 198 A1 | 5/2001 |
| ES | 2 003 150 | 10/1988 |
| ES | 2 003 151 | 10/1988 |
| ES | 2 003 415 | 11/1988 |
| ES | 2 007 032 | 5/1989 |
| ES | 2 049 577 | 4/1994 |
| FR | 2 790 919 | 9/2000 |
| FR | 2 824 452 | 11/2002 |
| WO | WO 98/47401 | 10/1998 |
| WO | WO 01/19212 | 3/2001 |
| WO | WO 02/00053 | 1/2002 |

* cited by examiner

FIG 8
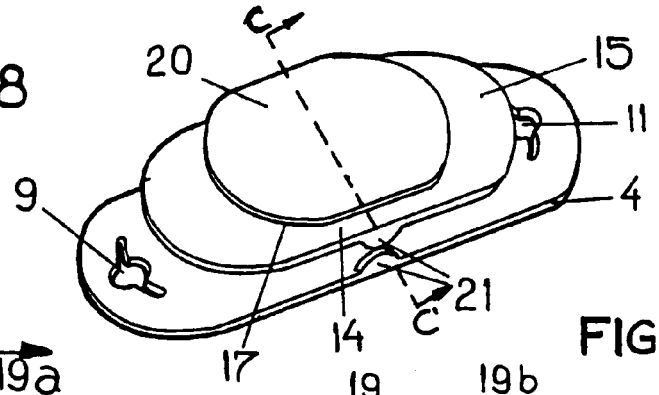
FIG 9a
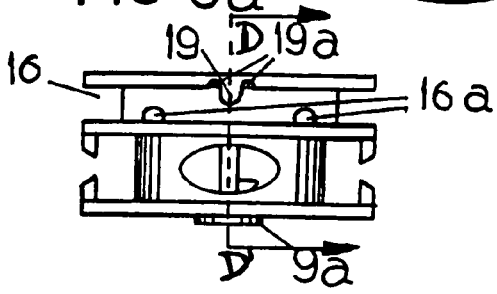
FIG 9b
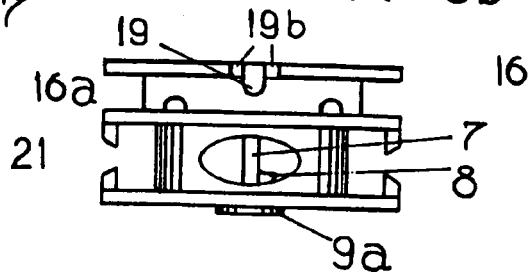
FIG 10
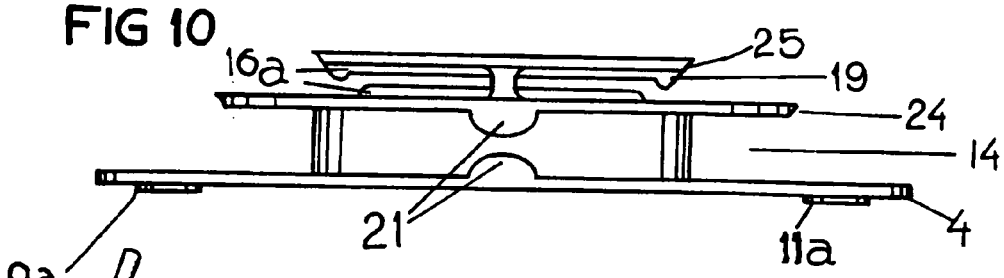
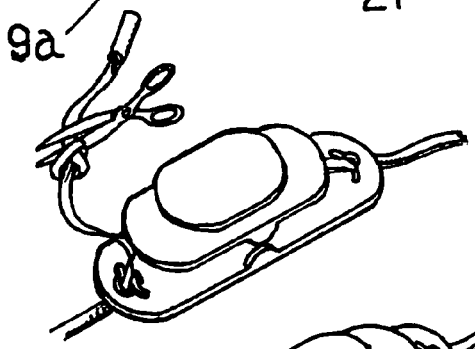
FIG 11
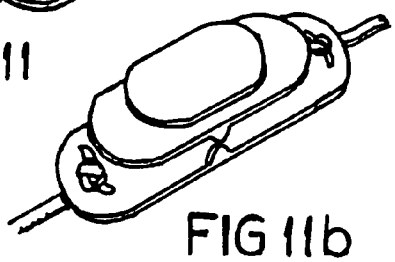
FIG 11b
FIG 12
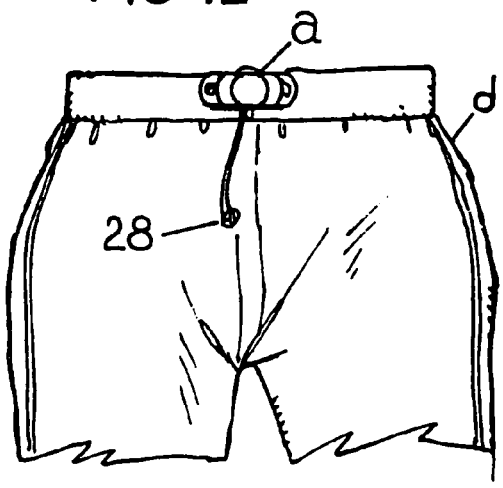

ANCHORING DEVICE FOR FASTENING LACES

I—Background of the invention

1. Field of Invention

The present invention consists in an anchoring device for fastening laces which replaces tying laces with knots, which are generally unsafe and difficult to tie, and which ties laces safely preventing them from loosening. It is very easy to manipulate, enabling the user to use only one hand. Furthermore, it is remarkably more aesthetic than conventional fastening means, and thus it can be applied to various items with laces and to tie and anchor laces and cords in general.

2. Description of Prior Art

There are various articles which, in order to be closed, tied or fastened, require laces or cords. The most common case is that of shoe laces, camping tents and bags around the mouths of which there are some eyelets though which a lace runs, and of certain types of trousers and other items of clothing. In all of these cases, in order to close the article, both ends must be pulled, so that when the lace runs through said eyelets, the mouth is closed by tightening the flexible walls that surround it. To secure the closure, the lace must be knotted using both hands, by means of double or multiple knots so that they do not loosen and open, or by means of a simple knot, to make it easy to untie.

One of the most popular applications of the present invention might be with shoe laces. In this case, the lace is generally a long and flexible member, the ends of which are rigid, so that they can be threaded through each of the eyelets in the edges of the shoe opening, in order to tight the laces on the shoe tongue in the instep area.

This traditional system has several drawbacks:

It is troublesome to fasten and tie a knot.

The position in which the user must perform this operation is uncomfortable and demands effort.

These knots are constantly loosening.

It is unhygienic: when laces suddenly get loose, they are dragged on the ground, become contaminated, and then are touched by the user.

It is dangerous: loose laces can be involuntarily stepped on, causing accidents, usually among children.

It is uncomfortable: to prevent laces from loosening, many users make a double knot, which makes the tying and untying process more difficult.

In all cases, the knot is highly unaesthetic.

For a very long time, systems have been sought to replace conventional knots, as it is shown by the numerous patents in that sense, such as U.S. Pat. Nos. 5,315,741, 4,485,529, 3,473,198, 3,864,790, 6,473,944, 6,148,489, 6,247,214, 6,502,286, 5,903,959, U.S. 2003/0000053, U.S. 2003/0126726, U.S. 2003/0070268, U.S. Pat. Nos. 3,057,029, 3,176,362, 2,254,579, 2,164,123, 3,290,745, 4,553,293, AU 200071707, ES 2049577, ES 2007032, ES 2003415, ES 2003151, ES 2003150, EP 1103198, EP 0337044, EP 0314628, DP G 9206822.7, DP G 8913481.8, DE 29808021, DE 20116755, FR 2790919, FR 2824452, PCT/U.S.97/22967-WO98/47401, PCT/FR00/02520-WO 01/19212 and PCT/KR01/01080 WO 02/00053.

These patents are completely different from the present invention since they use complex mechanisms and most of them lack the winding system for the excess lace. In all cases, both ends of the lace are used, making it essential for the user to use both hands.

II—SUMMARY OF THE INVENTION

The present invention consists in an anchoring device for fastening laces which replaces tying laces with knots, which are generally unsafe and difficult to tie, and which ties laces safely preventing them from loosening. It is very easy to manipulate, enabling the user to use only one hand. Furthermore, it is remarkably more aesthetic than conventional fastening means, and thus it can be applied to various items with laces and to tie and anchor laces and cords in general.

Objects and Advantages

The fastening and anchoring device of the present invention solves all these inconveniences and offers the following advantages:

1. An end of the lace is simply and safely held in the bottom part of the device, running through all the eyelets of the shoe tongue (this being the fixed lace end), which does not slide in the eyelets when the other end is tightened and tied.

2. It is not necessary to make knots, as the device has a pair of overlapping throats in which the free end of the lace enters to be tightened by winding it at least twice around each of the throats.

3. The top throat allows for the final section of the lace to be knotted in a much more aesthetic way than known knots, or to be left free, without touching the ground, thus avoiding conventional fastening.

4. These operations can be done using only one hand so that, in the case of shoes, the position of the body to tighten and fasten the lace is much more comfortable.

5. The fact that it is easier to tighten and that it requires less effort makes its use easier for obese people, disabled people, old people and, particularly, children, who can learn more easily to use the present fastening and anchoring device than to tie a traditional knot.

6. The free end of the lace remains firmly held inside the top throat by means of retention elements.

7. To tighten and fasten the lace is much faster.

8. This system is highly aesthetic.

In the present invention, the winding of the lace and its fastening can be done with only one hand, since in all types of shoes only one end of the lace is active, sliding through the eyelets next to the tightening point, rendering it unnecessary to tighten the other end as it cannot slide.

It is enough to wind two turns of the lace around each of the two throats of the device of the present invention in order to tighten and fasten it, because the overlapping of the lace causes instant tightening, and the ledges situated in the borders of the walls of both throats withhold the lace inside of them. As can be clearly appreciated, this novel and practical invention simplifies the process of tightening and fastening laces in shoes, clothes and other applications, making it safer, more aesthetic and faster.

The present invention can also be used to tighten and fasten any type of rope, such as the ones used in ships and for any other purpose which requires simplicity, speed and safety.

The fastening and anchoring device of the present invention does not require any type of knot, since only with a couple of turns around each of its throats, the lace is perfectly fastened and anchored and it does not loosen or untie. From the aesthetic point of view, it is more harmonic and attractive than the conventional unsafe knot system.

III—DESCRIPTION OF THE DRAWINGS

For the sake of clarity and to understand the object of the invention, it is illustrated with various figures in which it has been represented in one of its preferred embodiments, which is purely exemplary and therefore nonlimiting:

FIG. 1*a* is a top perspective view in which the general structure of the present tightening and fastening device can be appreciated, in one form of manufacture with curved surfaces along its longest length. It can be seen how the end of the lace that comes from the eyelets enters through the supporting base. FIG. 1*b* shows the top capping wall (17) onto which the yielding piece 17*a* adapts and is fixed as a retention means for the lace in the top throat.

Figure 1A:
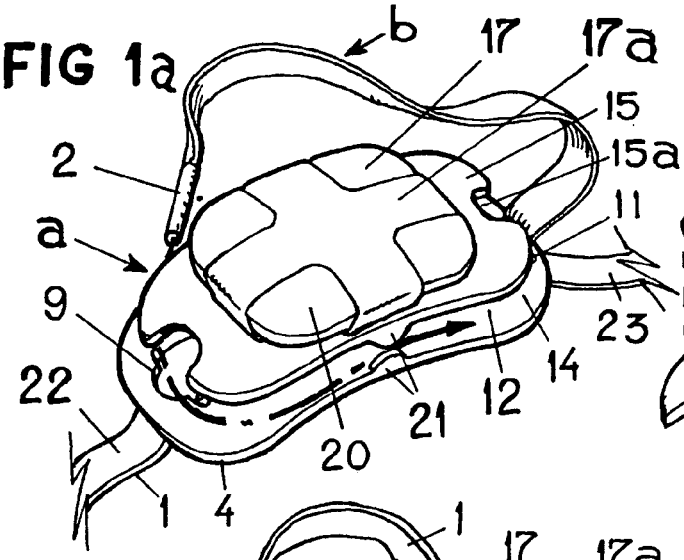
Figure 1B:
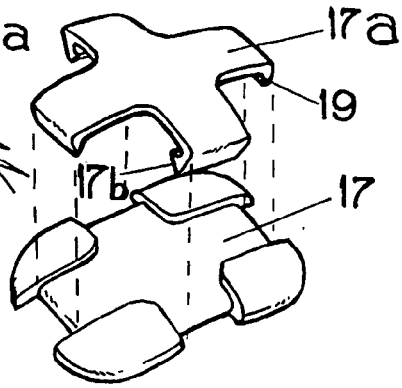
Figure 2:
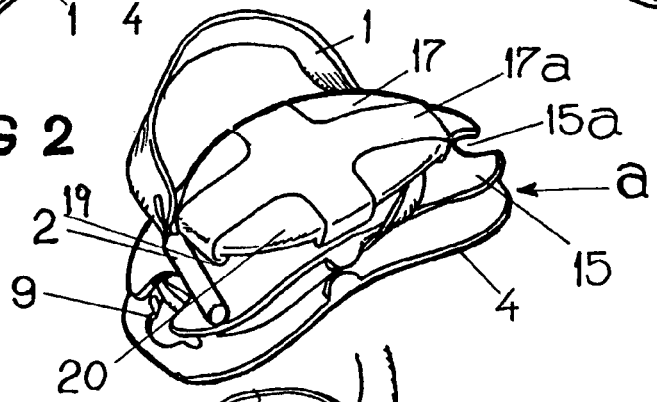
FIG. 2 is a perspective view as FIG. 1 which shows how the lace has been wound around the bottom throat of the reel and comes out towards the top reel.
Figure 3:
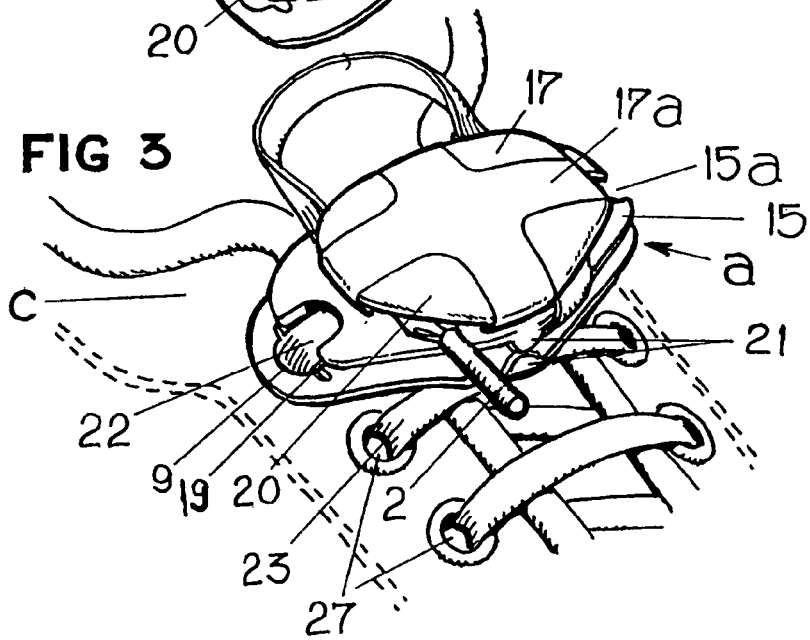
FIG. 3 is another perspective view as FIG. 1 which also shows the part of the shoe where the device lies and, how once the lace (b) has been wound around the bottom throat, the surplus is wound and fastened in the top throat, where it remains fastened by the yielding retention means (19) and the fixed compression means (16*a*) inside the throat.
Figure 4:
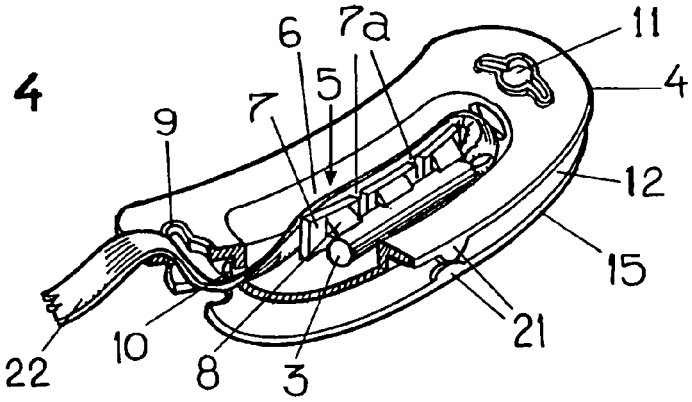
FIG. 4 is a bottom perspective view of the supporting base, with a partial cross-section, showing the anchoring means for the lace end.
Figure 5:
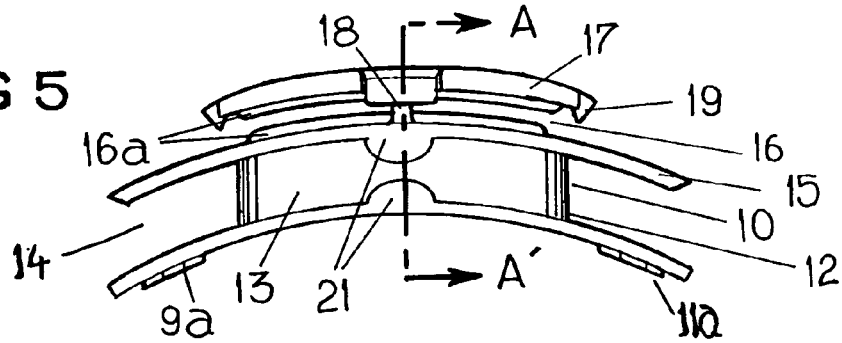
FIG. 5 is a side view of the device showing both the bottom throat (14) and the top throat (16).
Figure 6A:
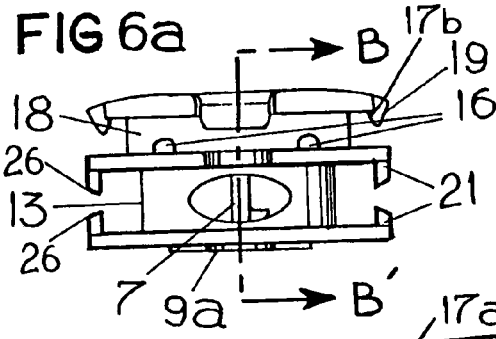
Figure 6B:
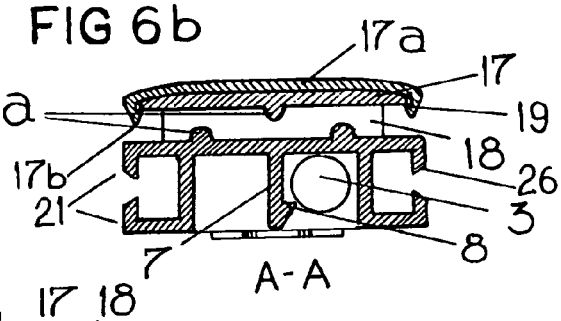

FIG. 6*a* is a cross sectional view of the device, and FIG. 6*b* is the same as FIG. 6*a*, showing the assembly of the additional piece (17*a*) by means of a fastening ledge (17*b*), according to a plane indicated as A–A' in FIG. 5.

Figure 7:
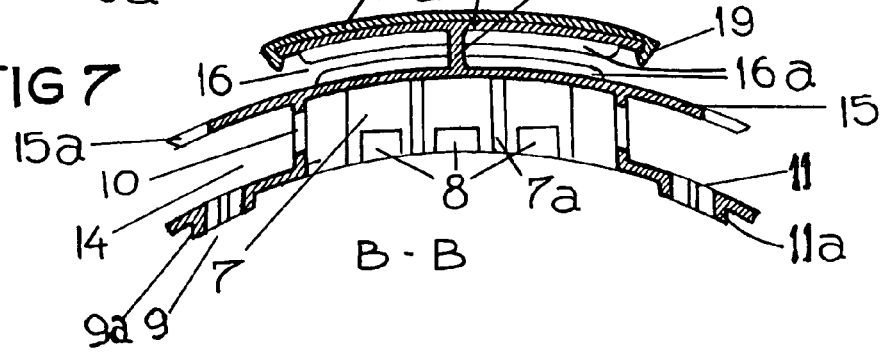

FIG. 7 is a middle longitudinal cross section, indicated as B–B' in FIG. 6*a*.

FIG. 8 is a top perspective view of a different manufacture with straight surfaces.

FIG. 9*a* is a cross section of the device, according to a plane C–C' of FIG. 8, FIG. 9*b* being the same as FIG. 9*a*, showing another manufacture with the yielding ledge 19.

FIG. 10 is a longitudinal cross section according to a plane D–D' of FIG. 9*a*.

FIG. 11 is a top perspective view showing the knot and cut of the farthest end of the lace to make it stop at the hole of the device and prevent it from leaving, as shown in FIG. 11*b*.

FIG. 12 is a front view of a pair of sports trousers, showing the device applied to it.

REFERENCE NUMERALS IN DRAWINGS (a) Anchoring device
(b) Lace
(c) Shoe (partial schematic view).
(d) Sports trousers.
(1) Long flexible body or member which integrates lace (b).
(2) Second rigid terminal of lace (b).
(3) First rigid terminal of lace (b).
(4) Supporting base.
(5) Anchoring means on supporting base (4).
(6) Labyrinth-like receptacle integrating the anchoring means (5).
(7) Central partitions.
(7*a*) Separation between sections of central partitions and walls of the labyrinth-like receptacle.
(8) Retention teeth on the bottom borders of the sections of partitions.
(9) Alternative outlets with (11) of lace (b), from the anchoring device to the eyelets (27) in the edges of the shoe opening.
(9*a*) Reinforced borders of holes (9).
(10) Alternative exit passages of the lace, from its anchoring on the supporting base towards the eyelets.
(11) Alternative entry with (9) of lace (b) coming from eyelets (27) in the edges of the shoe opening.
(11*a*) Reinforced border of (11).
(12) Reel for winding loops of lace (b).
(13) External walls of the labyrinth-like receptacle (6).
(14) Bottom throat corresponding to reel (12).
(15) Intermediate wall limiting reel (12) of top throat (16).
(16) Top throat formed between intermediate wall (15) and capping wall (17).
(17) Capping wall of top reel.
(17*a*) Additional yielding piece with retention means in top throat (16).
(17*b*) Elastic fastening means of piece (17*a*) in top throat (16).
(18) Support of capping wall (17) which links it with the top surface of wall (15).
(19) Retention means arranged in top throat (16) forming part of capping wall (17).
(19*a*) Weakening lines which make retention ledges (19) more yielding.
(20) External surface of capping wall (17).
(21) Retention ledges on the borders of bottom throat (14).
(22) Section of lace (b) going towards eyelets (27).
(23) Section of lace (b) coming from eyelets (27).
(24) Bottom wedging borders.
(25) Top wedging borders.
(26) Side wedging borders.
(27) Shoe eyelets (c).
(28) Retention knot at the end of lace (b).

IV—DETAILED DESCRIPTION

The present invention consists in an anchoring device (a) for fastening laces which, in general terms, comprises a structure with a supporting base (4) and a pair of overlapping throats (14) (16) which can hold sections of a fastening lace (b); the bottom throat (14) forms a reel (12) able to hold a winding section of the lace (b) with retention ledges (21), and the upper throat (16) forms another reel (12') with retention means (19) for the same lace (b); inside reel (12) there is an anchoring means (5) for one end of the lace (b), which applied to eyelets, has an exit (9) and an entry (11) on said supporting base (4).

The present device (a) is applicable to any laced item in general (such as bags, trousers, backpacks, etc.) and to shoes in particular. In this case, it is useful to fasten a lace (b), the body (1) or elongated flexible member of which finishes in end sections with rigid terminals (2) (3). These terminals, serving as means to initially thread the lace through the eyelets in the edges of the shoe opening, are used to tighten the lace on the shoe tongue in the instep area.

More particularly, the structure of the device (a) is integrated by three main walls (4) (15) (17) which in the present embodiment are of oval shape. The longest wall is the supporting base (4): in the centre of this supporting base (4) there is an anchoring means (5) for the first terminal (3) of the lace (b). This anchoring means (5) consists in a labyrinth-like receptacle (6) which is completely open on the bottom face of said supporting base (4) and which on its sides is limited by external walls (13), and on its top surface, it is limited by the bottom surface of the intermediate wall (15). Inside the labyrinth-like receptacle (6) there is a central partition (7) endowed with at least one retention tooth (8) which allows the anchoring of the first terminal (3) of the lace (b).

In another embodiment, said central partition (7) may comprise two or more sections defined by separations (7*a*) which give it more flexibility to hold the terminal (3) of the lace (b) in the labyrinth-like receptacle (6) of the supporting base (4).

The external walls (13) have two possible exit (9) passages (10) (10') (for a section (22) of the lace (b)) facing alternative exits (9) (9'), adjacent to the supporting base (4). Furthermore, said external walls (13) of the receptacle (6) form the core of a reel (12) around which the lace (b) is wound. The bottom throat of this reel (12) is designed to hold a winding loop formed by a section (23) of the lace (b) which, coming from the eyelets, enters through the alternative entry (11) of the supporting base (4). In the external border of that bottom throat (14) there are some retention ledges (21) with slanting borders to hold the lace (b).

The intermediate wall (15) limits the bottom throat (14) of reel (12), with respect to the top throat (16). The latter is formed by the existing cavity between said intermediate wall (15) and a capping wall (17) which stands on a support (18). Inside this top throat (16) there are some ledges which, acting as elastic yielding jaws, form retention means (19) of the last free section of the lace (b).

Said retention means consist in ledges, the bottom ends of which have a shape for wedging the lace (b). In this case, different forms of embodiment have been considered, for example, one in which these yielding retention means consist in an additional piece (17*a*) with retention ledges for the lace (19) and in which said piece is fixed on the top throat by means of ledges (17*b*). In another embodiment, the yielding retention means (19) are part of the capping wall (17), have some weakening side lines (21*a*) or two side slots (21*b*), which render it more elastically yielding.

The different lengths—from longest to shortest—of the supporting base (4), intermediate wall (15) and capping or top wall (17), in each case, allow to use the projecting part as a guiding means of the lace towards the adjacent throat. In the present embodiment, these guiding means are complemented with bottom (24), top (25) and side (26) wedging borders formed by the intermediate wall (15), capping wall (17) and retention ledges (19) (21), respectively.

With respect to the top or capping wall (17), it provides an external surface (20) which is suitable to fix advertising means, ornaments or reflective fluorescent means to be seen in the dark.

This anchoring device for fastening laces may be constructed in one single piece or different pieces fixed to each other. In this last case, they can be made of the same or different materials. They can also be of curved or straight surfaces, parallel to each other.

Operation.

The first terminal (3) of the lace (b) is held in the anchoring means (5) of the supporting base (4). Through passage (10) and exit (9), a section (22) of the lace (b) goes towards the eyelets. Once threaded, another section (23) of the lace (b) enters through entry (14) of reel (11) and is arranged as a winding loop inside the bottom throat (14) of reel (12), where it is held by retention ledges (21). The following section of the lace (b) enters the top throat (6) where the respective retention means (19) come into action.

What is claimed is:

1. An anchoring device which may be applied to a laced fastening member used in conjunction with clothes, bags, tents or shoes, having eyelets, and wherein the laced fastening member comprises an elongated flexible member having first and second terminal ends which permit the fastening member to pass through an exit hole in the anchoring device, through the eyelets of the object being secured, and through an entry hole in the anchoring device, the anchoring device comprising:

a supporting base on which a pair of overlapping throat members are structurally arranged for holding sections of the laced fastening member;

an anchoring assembly positioned in said supporting base to secure the first terminal end and to permit the laced fastening member to exit the exit hole to engage to eyelets of the object being secured, with said entry hole positioned in said supporting base to permit the second terminal end of the laced fastening member to pass from the eyelets of the object being secured to the anchoring device;

a reel member positioned about said anchoring assembly and associated with one of said throat members to permit the laced fastening member to be wound thereon, with said reel member being positioned between said supporting base and an intermediate wall, with said supporting base and said intermediate wall having retention ledges to maintain the laced fastening member about the reel member; and wherein the other of said throat members is mounted on said intermediate wall and includes a cap member thereon with said other of said throat members structurally arranged to receive the second terminal end of the laced fastening member and to secure the second end to the anchoring device.

2. The anchoring device for laced fastening member according to claim 1, wherein said supporting base projects with respect to said reel member as a guiding means for the lace towards one of said throat members, while said intermediate wall projects with respect to the other of said throat member as a guiding means for the lace towards said other of said throat members.

3. The anchoring device for laced fastening member according to claim 1, wherein said supporting base is a fastening stop against the edge of the shoe opening of application.

4. The anchoring device for laced fastening member according to claim 1, wherein said anchoring assembly consists in a labyrinth-like receptacle, the external walls of which form the winding core of the reel member having two passages diametrically opposed, which communicate said labyrinth-like receptacle with the exit hole on said supporting base.

5. The anchoring device for laced fastening member according to claim 1, wherein said supporting base, the reel member and an upper throat member are defined by three overlapping walls positioned parallel to each other, the perimetrical borders of which are oval in shape and of different lengths, the longest length being said supporting base and a bottom throat member and the shortest length corresponding to the cap member which defines the upper throat member; the intermediate wall is separated from said supporting base by the core of the reel member around which is the bottom throat member and, on its opposite side, is separated from the cap member by the upper throat member.

6. The anchoring device for laced fastening member according to claim 1, wherein said cap member provides an external surface suitable to fix advertising means.

7. The anchoring device for laced fastening member according to claim 1, wherein the cap member provides an external surface suitable to fix ornaments.

8. The anchoring device for laced fastening member according to claim 4, wherein the labyrinth-like receptacle is defined by the presence in its central part of a partition formed by at least two aligned parts in a straight line separated from each other and from the perimetrical wall, and having a fastening means of one of the terminal ends of the lace by folding its rigid terminal end onto its flexible adjacent section, contacting each of them the respective surfaces of the longitudinal walls of the partition segments interposed between them.

9. The anchoring device for laced fastening member according to claim 8, wherein the partitions of the labyrinth-like receptacle include retention means for the rigid terminal end of the laced fastening member and of its flexible adjacent portion, folded onto its longitudinal walls, consisting of at least one straight ledge in its bottom borders.

10. The anchoring device for laced fastening member according to claim 8, wherein the labyrinth-like receptacle communicates with a bottom throat member of the reel member through two alternative passages facing the exit opening in said supporting base.

11. The anchoring device for laced fastening member according to claim 1, wherein the access areas to said throat members and in the fastening ledges have borders that have slanting bevels for wedging the lace member.

12. The anchoring device for laced fastening member according to claim 1, wherein said other of said throat members has retention means comprised of a fastening ledge at diametrically opposing angles.

13. The anchoring device for laced fastening member according to claim 12, wherein said fastening ledge is elastically yielding, forming part of the cap member with side cooperating slots.

14. The anchoring device for laced fastening member according to claim 13, wherein said fastening ledge is elastically yielding, having side cooperating weakening lines.

15. The anchoring device for laced fastening member according to claim 12, wherein said fastening ledge is elastically yielding and is formed by a cross-shaped member fixed by two of its branches to the middle part of the front-back diameter of an upper throat member, by means of at least two bottom ledges angled at their ends, with a fastening mechanism inside said throat member, the bottom portion of both ends of their other transversal branch having, at least, another two ledges at an angle extending up to the interior of a top throat member.

16. The anchoring device for laced fastening member according to claim 1, wherein on the surfaces of the intermediate wall and cap member there is a plurality of lineal ledges oriented in the direction of the axis joining the end holes for the passage of the laced fastening member to provide a holding means of the last section of the lace member.

17. The anchoring device for laced fastening member according to claim 1, wherein in the direction of the axis joining the exit and inlet holes for the passage of the laced fastening member all the components have straight surfaces.

18. The anchoring device for laced fastening member according to claim 1, wherein the direction of the axis joining the exit holes for the passage of the laced fastening member all the components have curved surfaces.

19. The anchoring device for laced fastening member according to claim 1, which is an integral single member.

* * * * *

UNITED STATES PATENT AND TRADEMARK OFFICE

CERTIFICATE OF CORRECTION

PATENT NO. : 7,143,486 B2
APPLICATION NO. : 10/847181
DATED : December 5, 2006
INVENTOR(S) : Jose Santiago Rolla It is certified that error appears in the above-identified patent and that said Letters Patent is hereby corrected as shown below:

Col. 5, Line 67 please add
--In those embodiments in which the labyrinth-like receptacle (6) has two passages (10) on two opposing ends, these passages (10) are of alternative use. The entry (11) and the exit (9) may reverse their functions, since the opening adjacent to the active passage (10) with act as exit (9) for the lace (b).--

Signed and Sealed this

Twenty-fourth Day of April, 2007

JON W. DUDAS
*Director of the United States Patent and Trademark Office*